US009395676B2

(12) United States Patent
Sakaguchi et al.

(10) Patent No.: US 9,395,676 B2
(45) Date of Patent: Jul. 19, 2016

(54) CLEANING BLADE HAVING AN ELASTIC BODY OF SEGMENTED HARDNESSES, AND IMAGE FORMING APPARATUS AND PROCESS CARTRIDGE INCLUDING THE CLEANING BLADE

(71) Applicants: Hiromi Sakaguchi, Kanagawa (JP); Shinji Nohsho, Tokyo (JP); Masahiro Ohmori, Kanagawa (JP); Yohta Sakon, Kanagawa (JP); Masanobu Gondoh, Kanagawa (JP); Shohei Gohda, Kanagawa (JP); Kaori Toyama, Kanagawa (JP)

(72) Inventors: Hiromi Sakaguchi, Kanagawa (JP); Shinji Nohsho, Tokyo (JP); Masahiro Ohmori, Kanagawa (JP); Yohta Sakon, Kanagawa (JP); Masanobu Gondoh, Kanagawa (JP); Shohei Gohda, Kanagawa (JP); Kaori Toyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/624,700

(22) Filed: Feb. 18, 2015

(65) Prior Publication Data

US 2015/0253722 A1 Sep. 10, 2015

(30) Foreign Application Priority Data

Mar. 7, 2014 (JP) ..... 2014-045578

(51) Int. Cl.
*G03G 21/00* (2006.01)

(52) U.S. Cl.
CPC ..... *G03G 21/0017* (2013.01)

(58) Field of Classification Search
CPC ..... G03G 21/0017; G03G 21/0011
See application file for complete search history.

(56) References Cited

U.S. PATENT DOCUMENTS

| | | | |
|---|---|---|---|
| 4,957,839 | A | 9/1990 | Rokutanzono et al. |
| 5,008,172 | A | 4/1991 | Rokutanzono et al. |
| 5,147,751 | A | 9/1992 | Kojima et al. |
| 5,342,718 | A | 8/1994 | Nousho et al. |
| 5,991,573 | A | 11/1999 | Nohsho et al. |
| 6,030,733 | A | 2/2000 | Kami et al. |
| 6,060,205 | A | 5/2000 | Takeichi et al. |
| 6,151,468 | A | 11/2000 | Kami et al. |
| 6,160,977 | A | 12/2000 | Takeichi et al. |
| 6,363,237 | B1 | 3/2002 | Nagame et al. |
| 6,521,386 | B1 | 2/2003 | Sakon et al. |
| 6,562,529 | B1 | 5/2003 | Kojima et al. |

(Continued)

FOREIGN PATENT DOCUMENTS

| | | | |
|---|---|---|---|
| JP | 201013431 A | * | 6/2010 |
| JP | 2010-152295 | | 7/2010 |

*Primary Examiner* — David Gray
*Assistant Examiner* — Laura Roth
(74) *Attorney, Agent, or Firm* — Cooper & Dunham LLP

(57) ABSTRACT

A cleaning blade cleaning the surface of an object includes a rigid holder; and a strip-shaped elastic body fixed on the holder, including a tip ridgeline contacting the surface of the object. The elastic body has a length (L) projecting from the holder not less than 4 mm, a Martens hardness of from 1.0 to 10.0 N/mm$^2$ from the tip ridgeline to the middle (L/2) thereof, and a Martens hardness of from 0.3 to 0.8 N/mm$^2$ from the middle (L/2) thereof.

7 Claims, 5 Drawing Sheets

(56) References Cited

U.S. PATENT DOCUMENTS

2001/0031411 A1 10/2001 Kojima et al.
2002/0051654 A1 5/2002 Niimi et al.
2002/0115005 A1 8/2002 Ikuno et al.
2002/0197549 A1 12/2002 Sakon et al.
2003/0035661 A1 2/2003 Kabata et al.
2003/0049555 A1 3/2003 Sakon et al.
2003/0152854 A1 8/2003 Kojima et al.
2003/0165757 A1 9/2003 Kojima et al.
2003/0219279 A1 11/2003 Nohsho et al.
2004/0048178 A1 3/2004 Ikuno et al.
2004/0058260 A1 3/2004 Katoh et al.
2005/0026058 A1 2/2005 Kami et al.
2005/0031377 A1 2/2005 Kabata et al.
2005/0053853 A1 3/2005 Sugino et al.
2005/0118518 A1 6/2005 Ikegami et al.
2005/0238977 A1 10/2005 Kojima et al.
2006/0062595 A1 3/2006 Nousho et al.
2006/0210908 A1 9/2006 Umemura et al.
2006/0269323 A1 11/2006 Kabata et al.
2007/0287083 A1 12/2007 Gondoh et al.
2008/0063962 A1 3/2008 Toshine et al.
2008/0102391 A1 5/2008 Yanagawa et al.
2008/0112742 A1 5/2008 Nakamori et al.
2008/0113285 A1 5/2008 Nakamori et al.
2008/0219694 A1 9/2008 Nakamori et al.
2008/0227007 A1 9/2008 Tamoto et al.
2009/0035017 A1 2/2009 Tada et al.
2009/0148186 A1 6/2009 Yasuda et al.
2009/0180788 A1 7/2009 Tamoto et al.
2009/0185821 A1 7/2009 Iwamoto et al.
2009/0311017 A1 12/2009 Ohmori et al.
2009/0324281 A1 12/2009 Tada et al.
2010/0010204 A1 1/2010 Ohta et al.
2010/0034549 A1* 2/2010 Nakamatsu ..... G03G 21/0023 399/71
2010/0067953 A1 3/2010 Nohsho et al.
2010/0129112 A1 5/2010 Tada et al.
2010/0232831 A1 9/2010 Fujiwara et al.
2010/0310975 A1 12/2010 Tada et al.
2010/0329741 A1 12/2010 Nohsho et al.
2011/0135361 A1 6/2011 Kabata et al.
2011/0159418 A1 6/2011 Sakaguchi et al.
2011/0159420 A1 6/2011 Sakaguchi et al.
2011/0200926 A1 8/2011 Tanaka et al.
2011/0217102 A1 9/2011 Ohmori et al.
2011/0229809 A1* 9/2011 Nukada ..... G03G 5/0614 430/56
2012/0021346 A1 1/2012 Nagayama et al.
2012/0063816 A1 3/2012 Yamashita et al.
2012/0063826 A1 3/2012 Ohmori et al.
2013/0064578 A1 3/2013 Yamashita et al.
2013/0189012 A1 7/2013 Sakon et al.
2013/0243506 A1 9/2013 Ikuno et al.
2013/0243507 A1 9/2013 Sakon et al.
2014/0064810 A1 3/2014 Iwamoto et al.
2014/0178103 A1 6/2014 Gohda et al.
2014/0205338 A1 7/2014 Gondoh et al.
2014/0270876 A1 9/2014 Yamashita et al.
2014/0341629 A1* 11/2014 Watanabe ..... G03G 21/0017 399/350
2014/0356042 A1 12/2014 Gondoh et al.
2015/0023707 A1 1/2015 Gohda et al.

* cited by examiner

CLEANING BLADE HAVING AN ELASTIC BODY OF SEGMENTED HARDNESSES, AND IMAGE FORMING APPARATUS AND PROCESS CARTRIDGE INCLUDING THE CLEANING BLADE

CROSS-REFERENCE TO RELATED APPLICATIONS

This patent application is based on and claims priority pursuant to 35 U.S.C. §119 to Japanese Patent Application No. 2014-045578, filed on Mar. 7, 2014, in the Japan Patent Office, the entire disclosure of which is hereby incorporated by reference herein.

BACKGROUND

1. Technical Field

The present invention relates to a cleaning blade, an image forming apparatus and a process cartridge.

2. Description of the Related Art

An electrophotographic image forming apparatus typically forms an image by the following process. Namely, first, an image bearer such as a photoconductor uniformly charged by a charger is scanned with light to form an electrostatic latent image thereon, and the electrostatic latent image is developed by an image developer. Next, a toner image formed on the image bearer by the development is directly or through an intermediate transferer on a recording sheet. An untransferred toner adhering to the surface of the image bearer is removed by a cleaning blade.

Japanese published unexamined application No. JP-2010-152295-A discloses a cleaning blade which is an elastic blade formed of a urethane rubber or the like and a surface layer harder than the elastic blade, which covers a tip ridgeline part thereof contacting an image bearer. This claims the blade removes a downsized and spheroidized polymerization toner well, and prevents the blade from turning over the tip ridgeline, making a noise and being abraded to have stable cleanability for long periods.

However, the cleaning blade disclosed in Japanese published unexamined application No. JP-2010-152295-A has lower followability to fine oscillation of the image bearer to cause poor cleaning due to its tip ridgeline having high hardness. Recently, needs for image forming apparatus with electrophotographic process at higher speed have been increasing. The higher image forming speed causes an axis of the image bearer rotating at high speed to finely oscillate. Therefore, the cleaning blade disclosed in Japanese published unexamined application No. JP-2010-152295-A is not sufficiently suitable for the higher speed image forming apparatus.

SUMMARY

Accordingly, one object of the present invention is to provide a cleaning blade preventing its tip ridgeline from turning over, itself from making a noise and being abraded to have stable cleanability even in high speed printing.

Another object of the present invention is to provide an image forming apparatus using the cleaning blade.

A further object of the present invention is to provide a process cartridge using the cleaning blade.

These objects and other objects of the present invention, either individually or collectively, have been satisfied by the discovery of a cleaning blade cleaning the surface of an object, including a rigid holder; and a strip-shaped elastic body fixed on the holder, comprising a tip ridgeline contacting the surface of the object, wherein the elastic body has a length (L) projecting from the holder not less than 4 mm, a Martens hardness of from 1.0 to 10 N/mm$^2$ from the tip ridgeline to the middle (L/2) thereof, and a Martens hardness of from 0.3 to 0.8 N/mm$^2$ from the middle (L/2) thereof.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
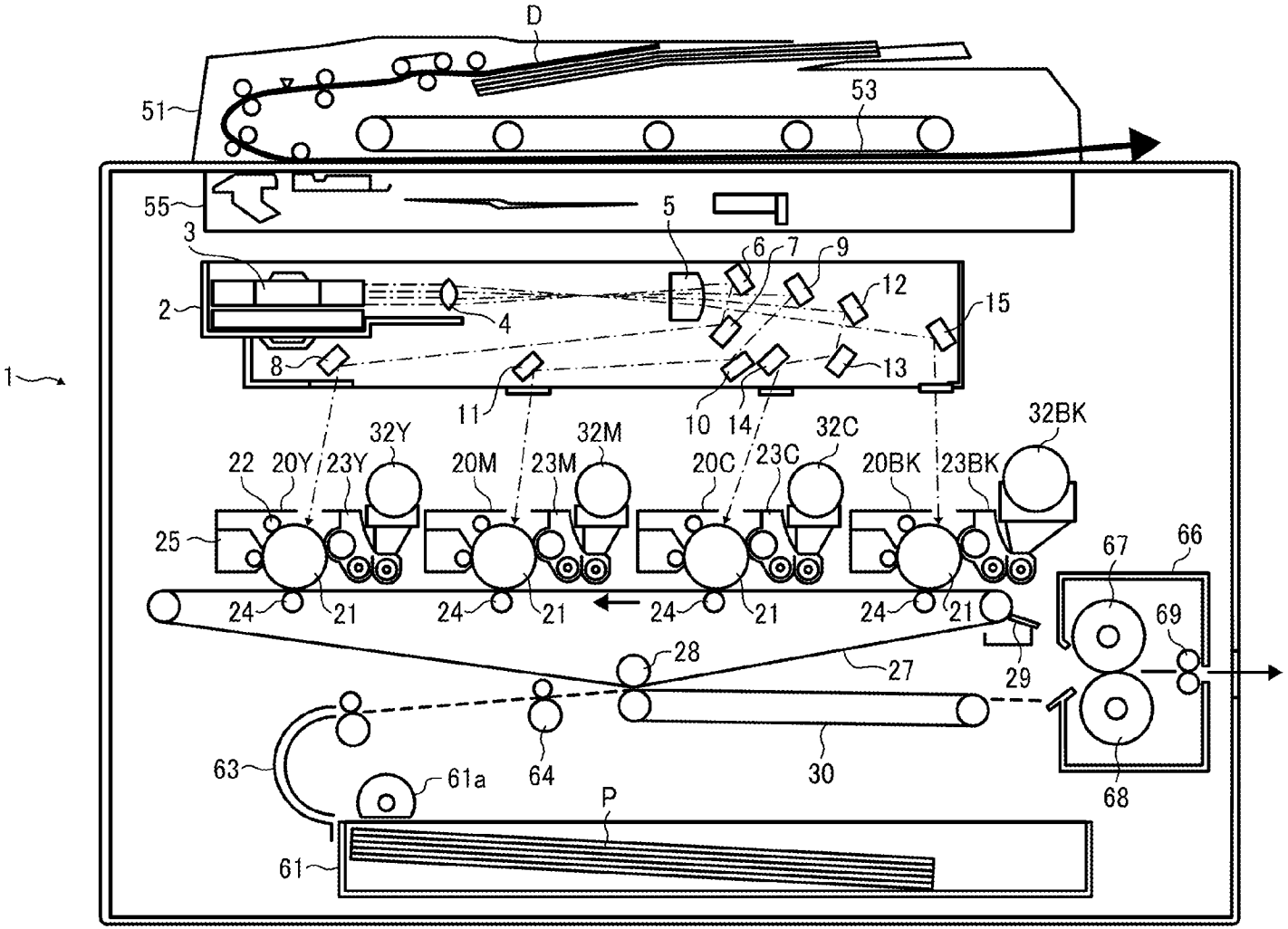
FIG. 1 is a schematic view illustrating an embodiment of the image forming apparatus of the present invention.

The present invention provides a cleaning blade preventing its tip ridgeline from turning over, itself from making a noise and being abraded to have stable cleanability even in high speed printing.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic view illustrating an embodiment of the image forming apparatus of the present invention.

As illustrated in FIG. 1, an image forming apparatus (full-color copier) 1 includes an imaging area forming a toner image. The imaging area includes an irradiating (writing) unit 2 emitting a laser beam based on image information. The image forming apparatus further process cartridges 20Y, 20M, 20C and 20BK for yellow, magenta, cyan and black, developing units 23Y, 23M, 23C and 23BK, toner supply units 32Y, 32M, 32C and 32BK, etc.

Each of the process cartridges 20Y, 20M, 20C and 20BK includes a photoconductive drum 21 as an image bearer, a charger 22 charging the surface of the photoconductive drum 21 and a cleaning unit 25 collecting an untransferred toner on the photoconductive drum 21. The irradiating (writing) unit 2 optically scans the uniformly-charged surface of each of the process cartridges 20Y, 20M, 20C and 20BK to form an electrostatic latent image on the surface of each of the photoconductive drums 21. Each of the developing units 23Y, 23M, 23C and 23BK develops the electrostatic latent image on each of the photoconductive drums 21. Each of the toner supply units 32Y, 32M, 32C and 32BK supplies each color toner to each of the developing units 23Y, 23M, 23C and 23BK.

Below the imaging area, an intermediate transfer belt 27 on which plural toner images are overlappingly transferred is provided. A transfer bias roller 24 transferring a toner image formed on the photoconductive drum 21 onto to the intermediate transfer belt 27 is provided opposite to the photoconductive drum 21 through the intermediate transfer belt 27. Further, the image forming apparatus 1 includes a second transfer bias roller 28 transferring a toner image on the intermediate transfer belt 27 onto a recording medium P and an intermediate transfer belt cleaning unit 29 collecting an untransferred toner on the intermediate transfer belt 27. Further, the image forming apparatus 1 includes a paper feed unit 61 containing recording media P such a transfer paper, a transfer belt 30 transferring the recoding medium P on which a 4-color toner image is transferred, and a fixing unit 66 fixing an unfixed image on the recoding medium P.

Above the image forming apparatus, a document reader 55 reading image information on a document D and a document feeder 51 feeding the document D to the document reader 55 are provided.

Hereinafter, typical color image formation in the image forming apparatus is explained.

First, the document D placed on a document tray of the document feeder 51 is transported in a direction shown by an arrow F in FIG. 1 with transport rollers, and placed on a contact glass 53 of the document reader 55 to optically read image information of the document D by the document reader 55.

Specifically, the document reader 55 emits light, generated with a light source (not illustrated), to an image on the document D placed on a contact glass 53. Light reflected from the document D is focused onto a color sensor (not illustrated) via mirrors and lenses. The color sensor reads color image information of the document D as RGB (i.e., red, green, and blue) information, and then converts RGB information to electric signals. Based on the electric signals for RGB information, an image processor (not illustrated) conducts various processes such as color converting process, color correction process, and spatial frequency correction process to obtain color image information of yellow, magenta, cyan, and black.

The color image information of yellow, magenta, cyan, and black are then transmitted to the irradiating unit 2. The irradiating unit 2 emits a laser beam corresponding to the color image information of yellow, magenta, cyan, and black, to the respective photoconductive drum 21 in the process cartridges 20Y, 20M, 20C and 20BK.

The photoconductive drum 21 is rotated in a clockwise direction in FIG. 1. The charger 22 uniformly charges the surface of the photoconductive drum 21 to form a charge potential about −700 V on the photoconductive drum 21.

When the charged surface of photoconductive drum 21 comes to an irradiation position, the irradiating unit 2 emits a laser beam corresponding to each color of yellow, magenta, cyan, and black. As illustrated in FIG. 1, the laser beam reflected at a polygon mirror 3 passes lenses 4 and 5, and then follows a separate light path for each color of yellow, magenta, cyan, and black (irradiating process).

A laser beam for yellow component, reflected on mirrors 6 to 8, irradiates the surface of the photoconductive drum 21 in the process cartridge 20Y as illustrated in FIG. 1. Such laser beam for yellow component is scanned in a main scanning direction of the photoconductive drum 21 with a rotation of the polygon mirror 3, rotating at a high speed. With such laser beam scanning, an electrostatic latent image for yellow component is formed on the photoconductive drum 21.

In a similar way, a laser beam for magenta component, reflected on mirrors 9 to 11, irradiates the surface of the photoconductive drum 21 in the process cartridge 20M as illustrated in FIG. 1, and an electrostatic latent image for magenta component is formed on the photoconductive drum 21. In a similar way, a laser beam for cyan component, reflected on mirrors 12 to 14, irradiates a surface of the photoconductive drum 21 in the process cartridge 20C as illustrated in FIG. 1, and an electrostatic latent image for cyan component is formed on the photoconductive drum 21. In a similar way, a laser beam for black component reflected on a mirror 15 irradiates a surface of the photoconductive drum 21 in the process cartridge 20BK as illustrated in FIG. 1, and an electrostatic latent image for black is formed on the photoconductive drum 21.

Then, each of the electrostatic latent images on the respective photoconductive drum 21 comes to a position facing each of the developing units 23Y, 23M, 23C, and 23BK. Each of the developing units 23Y, 23M, 23C, and 23BK supplies respective color toner (i.e., yellow, magenta, cyan, and black) to the respective photoconductive drum 21 to develop respective toner image on the respective photoconductive drum 21 (developing process).

After such developing process, the photoconductive drum 21 comes to a position facing the intermediate transfer belt 27. As illustrated in FIG. 1, four transfer bias rollers 24, provided at inner face of the intermediate transfer belt 27, face the respective photoconductive drum 21 via the intermediate transfer belt 27. Such four transfer bias rollers 24 are used to transfer toner images on the respective photoconductive drum 21 to the intermediate transfer belt 27 by superimposing toner images on the intermediate transfer belt 27 (first transfer process).

Then, the photoconductive drum 21 comes to a position facing the cleaning unit 25. The cleaning unit 25 recovers toners remained on the photoconductive drum 21 after developing process (cleaning process). Then, a discharger (not illustrated) discharges the photoconductive drum 21 to prepare the photoconductive drum 21 for a next image forming operation on the photoconductive drum 21.

The intermediate transfer belt 27 having toner images thereon travels in a direction shown by an arrow L in FIG. 1, and comes to a position of the second transfer bias roller 28. At the second transfer bias roller 28, the toner images are transferred from the intermediate transfer belt 27 to the recording medium P. Further, an image patch pattern, to be described later, is formed on the intermediate transfer belt 27 in a similar image forming process, wherein the image patch pattern is used for adjusting image forming condition or for correcting a displacement of color images. Then, the intermediate transfer belt 27 comes to a position facing the belt cleaning unit 29, which is used to recover toners remained on the intermediate transfer belt 27, by which a transfer process for intermediate transfer belt 27 completes.

During such image forming process, the recording medium P is transported to the position of the second transfer bias roller 28 from the paper feed unit 61 via a transport guide 63 and a registration roller 64.

Specifically, the recording medium P in the paper feed unit 61 is fed to the transport guide 63, and further fed to the registration roller 64. Such registration roller 64 feeds the recording medium P to the position of the second transfer bias roller 28 by synchronizing a feed timing with toner-image formation timing on the intermediate transfer belt 27.

Then, the recording medium P having the toner images thereon is transported to the fixing unit 66 by the transport belt 30. The fixing unit 66 includes a heat roller 67 and a pressure roller 68 as illustrated in FIG. 1. The fixing unit 66 fixes the toner images on the recording medium P at a fixing nip between the heat roller 67 and the pressure roller 68. After fixing the toner images on the recording medium P, the recording medium P is ejected from the image forming apparatus 1 by an ejection roller 69, by which an image forming process for one cycle is completed.

Figure 2:
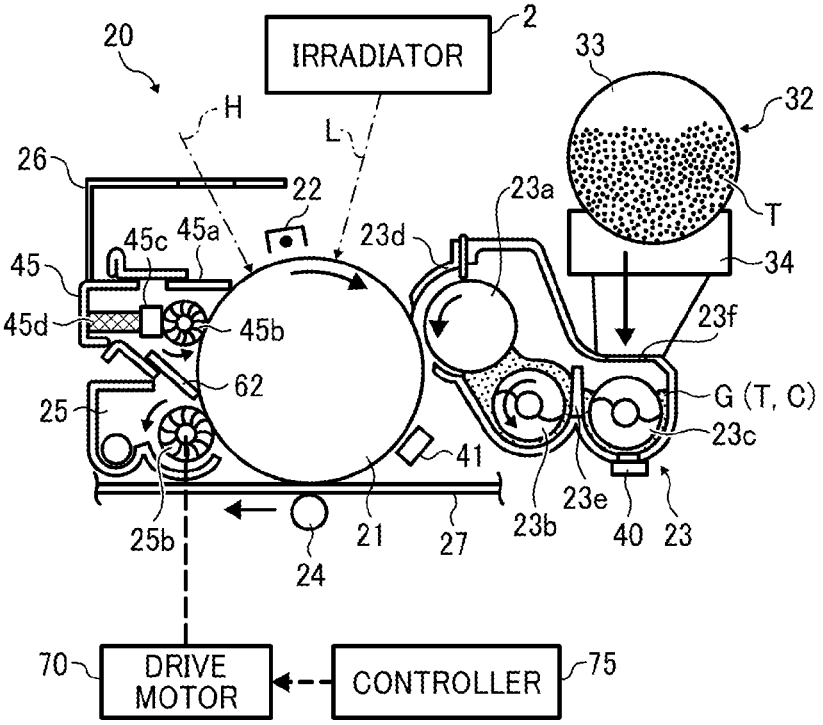
FIG. 2 is a sectional view illustrating an imaging area of the image forming apparatus in FIG. 1.

FIG. 2 is a sectional view illustrating an imaging area of the image forming apparatus in FIG. 1.

The image forming apparatus 1 includes four image forming sections for image forming process. Because the four image forming sections have a similar configuration one to another except a color of toner T, reference characters of Y, M, C, and K for process cartridges, developing units, and toner supply units or other parts are omitted from FIG. 2.

As illustrated in FIG. 2, the process cartridge 20 includes the photoconductive drum 21 as an image bearer, the charger 22, the cleaning unit 25 and a lubricant supplier 45 in a case 26. The process cartridge is exchanged at a predetermined cycle from the image forming apparatus 1. In a similar way, the developing unit 23 is exchanged at a predetermined cycle from the image forming apparatus 1.

(Image Bearer)

The photoconductive drum 21 as an image bearer is typically a negatively-chargeable organic photoconductor. The photoconductor may have a single-layered or multi-layered photosensitive layer. The photoconductor may have an intermediate layer between its substrate and photosensitive layer, and a surface layer on its outermost surface. The photoconductor of the present invention preferably has a surface layer including an acrylic cured resin. The surface layer may include a charge transport material and a particulate metal oxide besides the acrylic cured resin. The acrylic cured resin is obtained by curing a marketed acrylic monomer with UV light. In the present invention, the photoconductive drum 21 rotates at a high linear speed not less than 600 mm/sec for high-speed printing.

(Charger)

A corona wire is extended at the center of a U-shaped metal plate in the charger 22. A predetermined voltage is supplied from an unillustrated power source to the corona wire of the charger 22 so as to uniformly charge the surfaces of the photoconductor drum 21. Further, a metal grid panel may be provided on an opposing surface of the charger 22 that faces the photoconductor drum 21.

(Developing Means)

The developing unit 23 includes a developing roller 23*a* provided opposite the photoconductor 21, a first conveyance screw 23*b* provided opposite the developing roller 23*a*, a second conveyance screw 23*c* provided opposite the first conveyance screw 23*b* with a wall 23*e* interposed therebetween, and a doctor blade 23*d* provided opposite the developing roller 23*a*, away from the first conveyance screw 23*b*. The developing roller 23*a* is constructed of a magnet fixed therewithin to form magnetic poles around a surface of the developing roller 23*a* and a sleeve rotated around the magnet. Multiple magnetic poles are formed on the developing roller 23*a* by the magnet so that the developing roller 23*a* carries a developer G thereon.

The developer G, which in this case is a two-component developer including a carrier C and toner T, is stored in the developing unit 23.

Specifically, the toner T is a spherical toner having a circularity of not less than 0.98. A flow-type particle image analyzer FPIA-2000 manufactured by Sysmex Corporation was used to measure an average circularity of the toner T. Measurements were performed in the following manner. From 0.1 ml to 0.5 ml of surfactant (preferably alkylbenzene sulfonate) serving as a dispersant and from 0.1 g to 0.5 g of a sample, that is, toner, were added to from 100 ml to 150 ml of water, from which impurities were removed in advance. Subsequently, the mixture in which the toner is dispersed was dispersed using an ultrasonic dispersing machine for from 1 to 3 minutes to prepare a sample solution including 3,000 to 10,000 particles/μl. The sample solution thus prepared was then set to the flow-type particle image analyzer FPIA-2000 to measure the shape and particle size distribution of the toner T.

The spherical toner is formed by heating a deformed pulverization toner to be spheric and a polymerization method.

The toner supply unit 32 provided to the image forming apparatus 1 is constructed of a replaceable toner bottle 33 and a toner hopper 34 that holds and rotatably drives the toner bottle 33 as well as supplies a new toner T to the developing unit 23. The toner bottle 33 stores the new toner T of the specified color and has a spiral protrusion on an inner surface thereof.

It is to be noted that the new toner T is appropriately supplied from the toner bottle 33 into the developing unit 23 through a toner supply opening 23*f* in accordance with consumption of the toner T stored in the developing unit 23. A reflective-type photosensor 41 provided opposite the photoconductor 21 and a magnetic sensor 40 provided below the second conveyance screw 23*c* directly or indirectly detect consumption of the toner T in the developing unit 23.

A toner concentration (TC) in the developing unit 23 is controlled to be in a predetermined range. Specifically, the new toner T is appropriately supplied from the toner supply unit 32 to the developing unit 23 via the toner supply opening 23*f* provided to the developing unit 23 such that detected values output from the magnetic sensor 40 and the reflective-type photosensor 41 have the predetermined value.

(Lubricant Supplier)

The lubricant supplier 45 includes a lubricant supply roller 45*b* (lubricant supply brush roller) scraping the photoconductor drum 21 with a brush formed around the roller 45*b* to supply a lubricant to photoconductor drum 21 and a solid lubricant 45*c* contacting the lubricant supply roller 45*b*. The lubricant supplier 45 further includes a compression spring 45*d* biasing the solid lubricant 45*c* to the lubricant supply roller 45*b* and a thinning blade 45*a* (coating blade) contacting the photoconductor drum 21 to thin a lubricant supplied thereon.

The lubricant supplier 45 is located at downstream side in the rotational direction of the photoconductor drum 21 relative to the cleaning unit 25 (cleaning blade 62) and upstream side thereof relative to the charger 22.

The lubricant supply roller 45*b* includes a core bar and a brush wound around an outer circumference of the core bar, and rotates anticlockwise while the brush contacts the surface of the photoconductor drum 21 in FIG. 2.

Thus, a lubricant is supplied from the solid lubricant 45*c* onto the photoconductor drum 21 through the lubricant supply roller 45*b*.

The lubricant supplier 45 applies a lubricant to the surface of the photoconductor drum 21 and improves releasability (removability) of a toner to prevent poor cleaning.

The solid lubricant 45*c* is preferably zinc stearate. Specific examples of the solid lubricant 45*c* include, besides zinc stearate, stearate groups such as barium stearate, iron stearate, nickel stearate, cobalt stearate, copper stearate, strontium stearate, and calcium stearate; fatty acid groups such as zinc oleate, barium oleate, lead oleate, copper oleate, zinc palmitate, barium palmitate, lead palmitate, and copper palmitate. A caprylic acid group, a linolenic acid group, and a co-linolenic acid group can be used as the fatty acid groups. Yet further alternatively, waxes such as candelilla wax, carnauba wax, rice wax, haze wax, jojoba wax, bees wax, and lanoline can be used for the solid lubricant 45*c*. An organic solid lubricant compatible with toner is easily formed from the above-described materials.

The thinning blade 45*a* is a blade-shaped member formed of a rubber material such as polyurethane rubber and contacts the surface of the photoconductor drum 21 at a predetermined angle and a predetermined pressure. The thinning blade 45*a* is located at a downstream side in the rotational direction of the photoconductor drum 21 relative to the cleaning blade 62. The lubricant provided on the photoconductor drum 21 by the lubricant supply roller 45*b* is uniformly thinned thereon by the thinning blade 45*a* in a suitable amount.

When the solid lubricant 45*c* is applied to the surface of the photoconductor drum 21 through the lubricant supply roller 45*b*, the lubricant having the shape of a powder is applied thereto. However, since the lubricant does not exert its lubricity enough in the form of a powder, the thinning blade 45*a* works as a member thinning and uniforming the lubricant. The thinning blade 45*a* forms a film of the lubricant on the photoconductor drum 21 such that the lubricant sufficiently exerts its lubricity.

(Cleaner)

The cleaning unit 25 is formed of the cleaning blade 62 contacting the photoconductor drum 21 to cleaning the surface thereof, the cleaning roller 25*b* (cleaning brush) a brush scraping the photoconductor drum 21 is formed around, etc. The cleaning blade 62 contacts the surface of the photoconductor drum 21 at a predetermined angle and a predetermined pressure. Thus, adhering materials adhering to the photoconductor drum 21 are mechanically scraped off and collected in the cleaning unit 25.

Next, the cleaning blade 62 of the present invention is explained.

Figure 3:
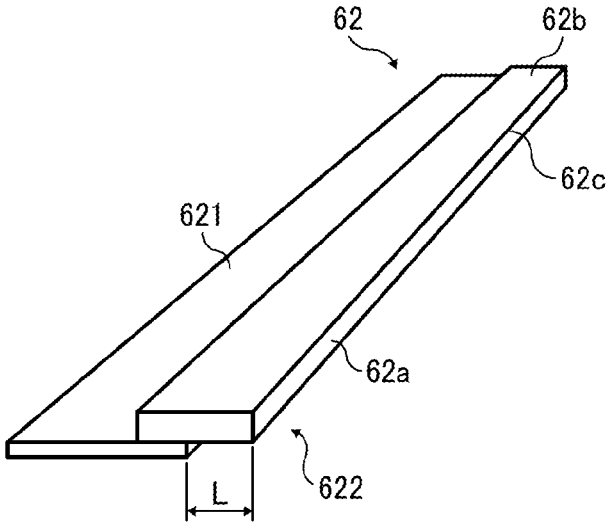
FIG. 3 is a perspective view illustrating an embodiment of the cleaning blade of the present invention.
Figure 4:
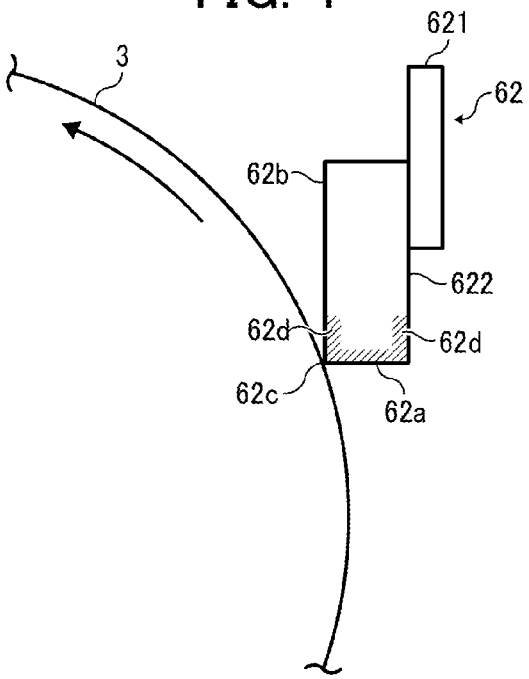
FIG. 4 is an amplified sectional view illustrating the cleaning blade.

FIG. 3 is a perspective view illustrating an embodiment of the cleaning blade of the present invention. FIG. 4 is an amplified sectional view illustrating the cleaning blade.

The cleaning blade 62 includes a strip-shaped holder 621 which is made of a rigid material such as metals and hard plastics, and a strip-shaped elastic blade 622. The holder 621 may be formed of any materials if it is capable of fixing the elastic blade 622. The elastic blade 622 is preferably a material having high impact resilience coefficient such as polyurethane.

In the present invention, a spherical toner is used to produce high-quality images. Such a spherical toner enters a slight gap between the cleaning blade 62 fornied of only a conventional rubber and the photoconductor drum 21, and soon scrapes off from the gap, occasionally resulting in poor cleaning.

Figure 5A:
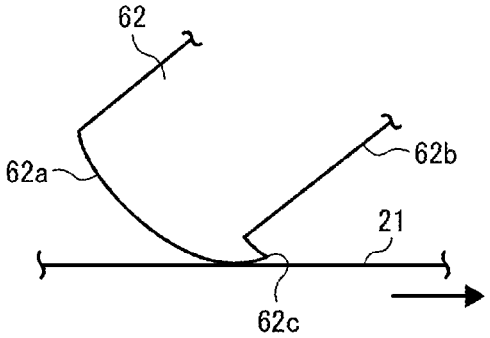
FIGS. 5A to 5C are schematic views for explaining how a cleaning blade is damaged.
Figure 5B:
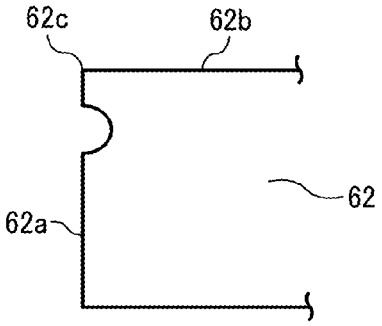
Figure 5C:
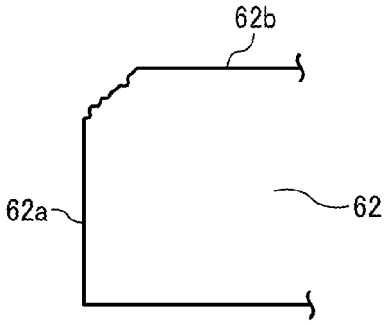

A contact pressure between the image bearer and the cleaning blade needs increasing to prevent the toner from scraping from the gap. However, when the contact pressure is increased, a friction between an image bearer 3 and a cleaning blade 62 in FIG. 5A increases, the cleaning blade 62 is drawn in a travel direction of the image bearer, and a tip ridgeline 62*c* of the cleaning blade 62 turns over. The cleaning blade 62 turned over occasionally makes noises when restored to its original state, resisting turning over. Further, when the cleaning continues while the tip ridgeline 62*c* of the cleaning blade 62 is turned over, a local abrasion is made a few μm from the tip ridgeline 62*c* of an edge surface 62*a* of the cleaning blade 62 as shown in FIG. 5B. When the cleaning continues further, the local abrasion becomes large and finally the tip ridgeline 62*c* is chipped as shown in FIG. 5C. When the tip ridgeline 62*c* lacks, a toner cannot normally be removed, resulting in poor cleaning.

In order to prevent the tip ridgeline 62*c* of the cleaning blade contacting the surface of the photoconductor drum from turning over, trials of hardening the edge to be difficult to deform are made. For example, a surface layer including an UV curing resin is formed on the tip ridgeline 62*c* of the cleaning blade or the elastic member such that the tip ridgeline 62*c* is hardened to prevent the tip ridgeline 62*c* from turning over. However, the cleaning blade has low followability to fine oscillation of the photoconductor drum 21 although highly hardened, and tends to cause poor cleaning. When the photoconductor drum 21 rotates at high speed not less than 600 mm/sec for high speed printing, the photoconductor drum 21 finely oscillates and the resultant high speed image forming apparatus does not have sufficient cleanability.

When the blade is hardened to prevent turning over and abrasion, the flexibility loses and followability lowers. When softened to increase followability, the blade tends to turn over and abrade. It is difficult to have both of prevention of turning over or abrasion and followability. Particularly, an image forming apparatus capable of forming images while rotating the photoconductor drum at high speed needs high followability, and is quite difficult to prevent turning over or abrasion. However, in the present invention, a profile of Martens hardness is specified in detail to have both high followability and prevention of turning over or abrasion.

Specifically, the cleaning blade having the following hardness profile has high followability and prevents turning over and abrasion. Namely, as FIG. 3 shows, when a length of the elastic blade projecting from the holder 621 to the tip ridgeline 62*c* is L, a Martens hardness from the tip ridgeline to the middle (L/2) is from 1.0 to 10 $N/mm^2$, from 0.3 to 0.8 $N/mm^2$ from the middle (L/2). This solves a problem of low followability of the cleaning blade having the highly-hardened tip ridgeline 62*c*. Further, Martens hardness is preferably maximum within 500 μm from the tip ridgeline 62*c*.

Figure 6:
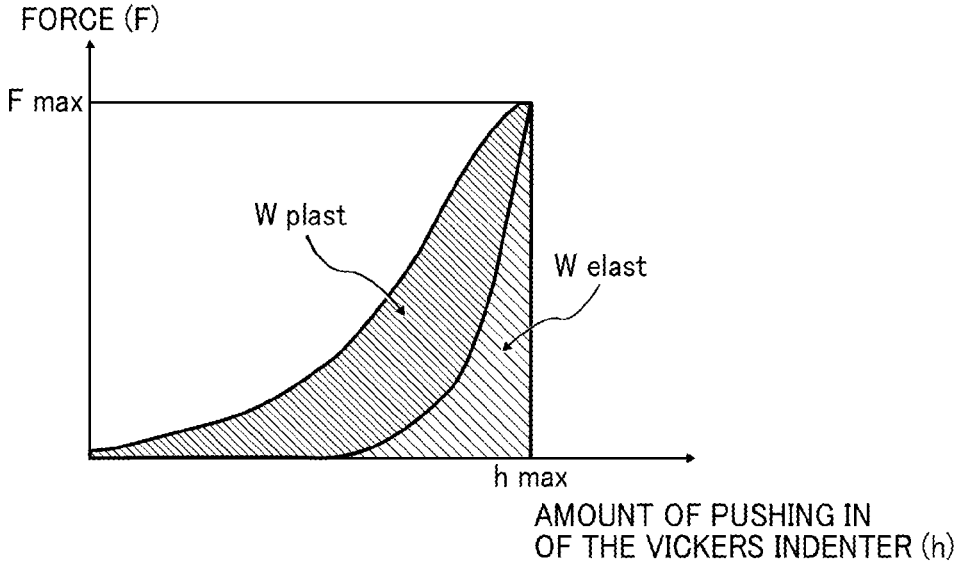
FIG. 6 is a diagram showing a multiplied stress Wplast when a Vickers indenter is pushed into and a multiplied stress Welast when a test load is released.

Marten's hardness is measured as follows. Namely, a microscopic hardness meter HM-2000 from Fischer Instruments is used, in which Vickers indenter is pushed into an object at 1.0 mN for 10 sec, held for 5 sec, and drawn at 1.0 mN for 10 sec. An elastic power is measured as follows from multiplied stress when measuring Martens hardness. When the multiplied stress when Vickers indenter is pushed into is Wplast and the multiplied stress when a test load is unloaded is Welast, the elastic power is Welast/Wplast×100% (FIG. 6). The higher the elastic power, the less the hysteresis loss (plastic deformation), i.e., closer to rubber. When the elastic power is too low, closer to glass.

The profile of Martens hardness is obtained by impregnating the elastic blade 622 such as polyurethane with a hardening resin monomer or forming a surface layer thereon to be highly hardened. Specifically, dipping the elastic blade 622 or spraying a liquid thereto so as to have a desired hardness profile. For example, when spraying, a distance from a spray gun to the elastic blade 622, a solvent and a spray speed vary the hardness profile. When a hardening resin monomer sprayed from a spray gun lands on the elastic blade 622 dry, the hardness profile of the present invention is difficult to obtain. A desired hardness profile is obtained when it is coatably wet. Therefore, a solvent having a boiling point not lower than 100° C. and low volatility such as cyclohexanone is preferably used alone to dissolve a hardening resin monomer. Further, a solvent having a boiling point not higher than 90° C. and high volatility such as tetrahydrofuran and methyl ethyl ketone is preferably mixed therewith. Depending on the solvent, coating conditions such as a discharge speed of the spray gun, an atomizing pressure and a work speed need optimizing. When dipping, dipping depth and the formulation of a coating liquid can control Martens hardness around the ridgeline of the elastic material. After dipping, the spray coating is made to obtain hardness profile of the present invention with ease.

The elastic blade 622 is preferably formed of, but is not limited to, polyurethane, and preferably has a Martens hardness not greater than 0.8 N/mm$^2$. Therefore, when the elastic blade 622 has a Martens hardness of from 0.3 to 0.8 N/mm$^2$, a part from the tip ridgeline 62*c* to the middle (L/2) thereof is coated or impregnated with a hardening resin monomer to have high hardness, i.e., a Martens hardness of from 1.0 to 10 N/mm$^2$.

Figure 7:
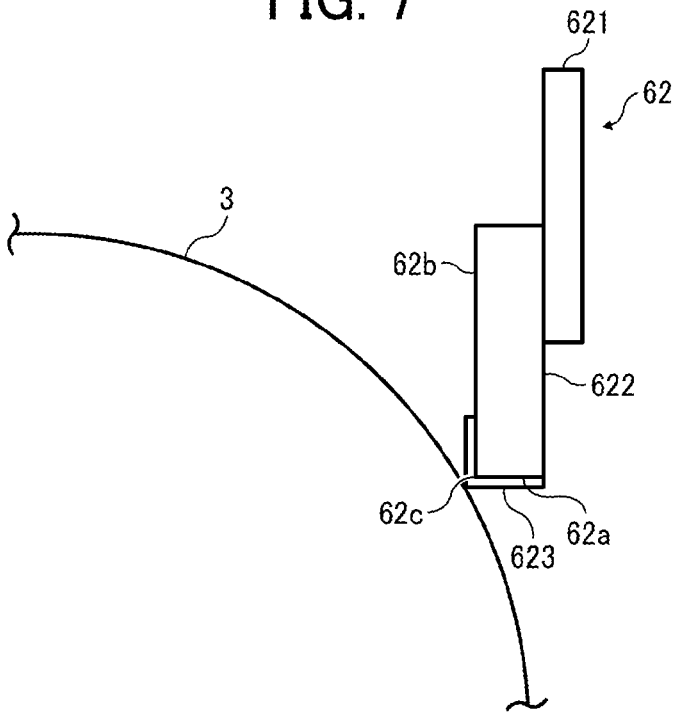
FIG. 7 is an amplified sectional view illustrating a cleaning blade including a surface layer.

The cleaning blade in FIG. 4 has an impregnated part 62*d* impregnated with a hardening resin monomer by dipping so as to have a Martens hardness of from 1.0 to 10 N/mm$^2$ from the tip ridgeline 62*c* to the middle (L/2) thereof. In addition, as FIG. 7 shows, a surface layer 623 formed of a hardening resin may be formed from the tip ridgeline 62*c* to the middle (L/2) so as to have a Martens hardness of from 1.0 to 10 N/mm$^2$. As FIG. 8, the elastic blade 622 may be impregnated with a hardening resin to form an impregnated part 62*d* and have a surface layer 623 formed of a hardening resin so as to have a Martens hardness of from 1.0 to 10 N/mm$^2$ from the tip ridgeline 62*c* to the middle (L/2) thereof.

Typically known hardening resin monomers such as UV curing resins and thermosetting resins can be used. However, the UV curing resins are preferably used because the elastic blade 622 and an adhesive fixing the holder 621 and the elastic blade 622 may be denatured with heat when the thermosetting resins are used.

Typical UV curing resins such as modified acrylate can be used, but the followings are preferably used to fully exert cleanability. Namely, when a surface layer is formed on the surface of the elastic blade by spray coating, pentaerythritol-triacrylate having a functional group equivalent molecular weight not greater than 350 and 3 to 6 functional groups is preferably used. When the elastic blade 622 is impregnated by dip coating, a (meth)acrylate compound having a tricyclodecane structure such as tricyclodecane methanol dimethacrylate is preferably used. These acrylates very effectively increase hardness of the elastic blade.

In addition, in the coating liquid in spraying and dipping, a polymerization initiator, a polymerization inhibitor, a diluted solvent, etc. besides the hardening resin monomers may be mixed. These are not particularly limited, and marketed products can be used.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Preparation of Coating Liquid)

<Coating Liquid 1>

| | |
|---|---|
| Resin 1: A-DCP from Shin-Nakamura Chemical Co., Ltd. | 100 |
| Resin 2: OPTOOL DAC-HP from DAIKIN INDUSTRIES, Ltd. | 2.5 |
| Polymerization initiator: Irgacure 184 from Ciba Specialty Chemicals | 1.5 |
| Solvent: Cyclohexanone | 900 |

Resin 1 A-DCP from Shin-Nakamura Chemical Co., Ltd. is tricyclodecane methanol dimethacrylate having two functional groups, a functional group equivalent molecular weight of 152 and the following formula.

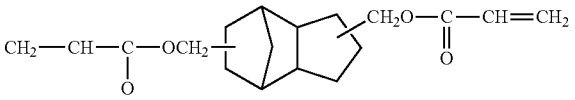

Resin 2 OPTOOL DAC-HP from DAIKIN INDUSTRIES, Ltd. is a fluorine-based acrylic monomer having a perfluoropolyether skeleton and two or more functional groups.

<Coating Liquid 2>

| | |
|---|---|
| Resin 1: DPHA from Daicel-cytech Company, Ltd. | 100 |
| Resin 2: OPTOOL DAC-HP from DAIKIN INDUSTRIES, Ltd. | 2.5 |
| Polymerization initiator: Irgacure 184 from Ciba Specialty Chemicals | 1.5 |
| Solvent: Cyclohexanone | 900 |

Resin 1 DPHA from Daicel-Cytec Company, Ltd. is pentaerythritol hexaacrylate having six functional groups, a functional group equivalent molecular weight of 96 and the following formula.

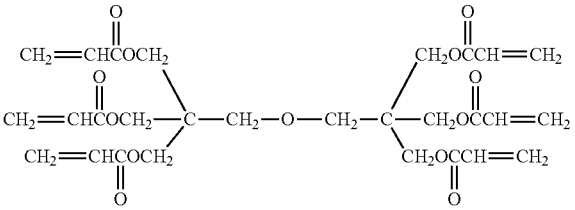

<Coating Liquid 3>

The procedure for preparation of the Coating Liquid 2 was repeated except for replacing 900 parts of cyclohexanone with 450 parts thereof and 450 parts of tetrahydrofuran.

<Coating Liquid 4>

The procedure for preparation of the Coating Liquid 2 was repeated except for replacing 900 parts of cyclohexanone with 900 parts of tetrahydrofuran.

(Preparation of Cleaning Blade)

<Cleaning Blade 1>

A single-layered urethane rubber having a JIS-A hardness of 73, an impact resilience coefficient of 17% and a Martens of 0.6 N/mm$^2$ was used as the elastic blade. JIS-A hardness was measured by a durometer from Shimadzu Corp. When measuring the hardness, sheets (with a thickness of about 2 mm) of each of the urethane rubbers were overlaid so that the rubber has a thickness of not less than 12 mm. The impact resilience coefficient of the urethane rubber was measured by a method defined in JIS K6255 using a resilience tester No. 221 manufactured by Toyo Seiki Seisaku-Sho Ltd. When measuring the resilience coefficient, sheets (with a thickness of about 2 mm) of each of the urethane rubbers were overlaid so that the rubber has a thickness of not less than 4 mm. The Martens hardness of the urethane rubber was measured by a microscopic hardness meter HM-2000 from Fischer Instruments is used, in which Vickers indenter is pushed into an object at 1.0 mN for 10 sec, held for 5 sec, and drawn at 1.0 mN for 10 sec.

The urethane rubber was fixed on the holder 621 formed of a metal plate with an adhesive so as to have a projected length L of 12 mm from the holder 621 as shown in FIG. 3.

The elastic blade 622 was highly hardened as follows. Namely, first, 1 mm from the ridgeline was dipped in the coating liquid 1 and kept therein for 90 sec to form an impregnated part 62*d*. Then, a residue was wiped off with a BEMCOT soaked with methyl ethyl ketone from Asahi Kasei Fibers Corp. Next, the coating liquid 2 was sprayed on the edge surface 62*a* of the blade in FIG. 3 to form a surface layer 623 thereon. A spray gun SV-91 from SAN-EI TECH Ltd. was used. The spray gun was fixed such that the tip thereof was at the middle of a short axis of the edge surface, the cleaning blade was horizontal in the longitudinal direction and the edge surface 62*a* of the blade in FIG. 3 was vertical. A distance from the tip of the pray gun to the urethane rubber was 60 mm. The coating liquid discharge speed was 0.04 cc/min, the atomizing pressure was 0.05 Mpa, and the spray gun reciprocated once at 5 mm/sec in the longitudinal direction of the cleaning blade.

Next, the coating liquid 2 was sprayed on an under surface 62*b* of the blade in FIG. 3 to form a surface layer 623 thereon as well. From a place 6.5 mm far from the tip ridgeline 62*c* of the urethane rubber to the holder 621 was masked with a PET film having a thickness of 100 μm using stickiness of the rubber to be uncoated. The spray gun was fixed such that the tip thereof had the same height of the tip ridgeline 62*c*, the cleaning blade was horizontal in the longitudinal direction and the under surface 62*b* of the blade was vertical. A distance from the tip of the pray gun to the urethane rubber was 60 mm. The coating liquid discharge speed was 0.06 cc/min, the atomizing pressure was 0.05 Mpa, and the spray gun reciprocated 1.5 times at 5 mm/sec in the longitudinal direction of the cleaning blade. Then, the cleaning blade was dried to touch for 3 min, irradiated with UV light (140 W/cm×5 m/min×5 passes), and dried at 100° C. for 20 min to prepare a cleaning blade 1.

<Cleaning Blade 2>

The procedure for preparation of the cleaning blade 1 was repeated except for changing the coating liquid discharge speed when coating the under surface 62*b* into 0.08 cc/min.

<Cleaning Blade 3>

The procedure for preparation of the cleaning blade 1 was repeated except for dipping the ridgeline in the coating liquid 1 for 180 sec.

<Cleaning Blade 4>

The procedure for preparation of the cleaning blade 1 was repeated except for not dipping the ridgeline in the coating liquid 1.

<Cleaning Blade 5>

The procedure for preparation of the cleaning blade 4 was repeated except for making the projected length L 10 mm from the holder 621 and masking a place 5.5 mm far from the tip ridgeline 62*c* when the under surface 62*b* was sprayed with the coating liquid 2.

<Cleaning Blade 6>

The procedure for preparation of the cleaning blade 1 was repeated except for changing the coating liquid discharge speed when coating the under surface 62*b* into 0.04 cc/min.

<Cleaning Blade 7>

The procedure for preparation of the cleaning blade 1 was repeated except for dipping the ridgeline in the coating liquid 1 for 15 min.

<Cleaning Blade 8>

The procedure for preparation of the cleaning blade 1 was repeated except for changing the coating liquid discharge speed when coating the under surface 62*b* into 0.12 cc/min without masking.

<Cleaning Blade 9>

The procedure for preparation of the cleaning blade 1 was repeated except for masking a place 4.5 mm far from the tip ridgeline 62*c* when the under surface 62*b* was sprayed with the coating liquid 2.

<Cleaning Blade 10>

The procedure for preparation of the cleaning blade 1 was repeated except for making the projected length L 4 mm from the holder 621 and masking a place 2.5 mm far from the tip ridgeline 62*c* when the under surface 62*b* was sprayed with the coating liquid 2.

<Cleaning Blade 11>

The procedure for preparation of the cleaning blade 1 was repeated except for making the projected length L 4 mm from the holder 621 without masking when the under surface 62*b* was sprayed with the coating liquid 2.

Figure 8:
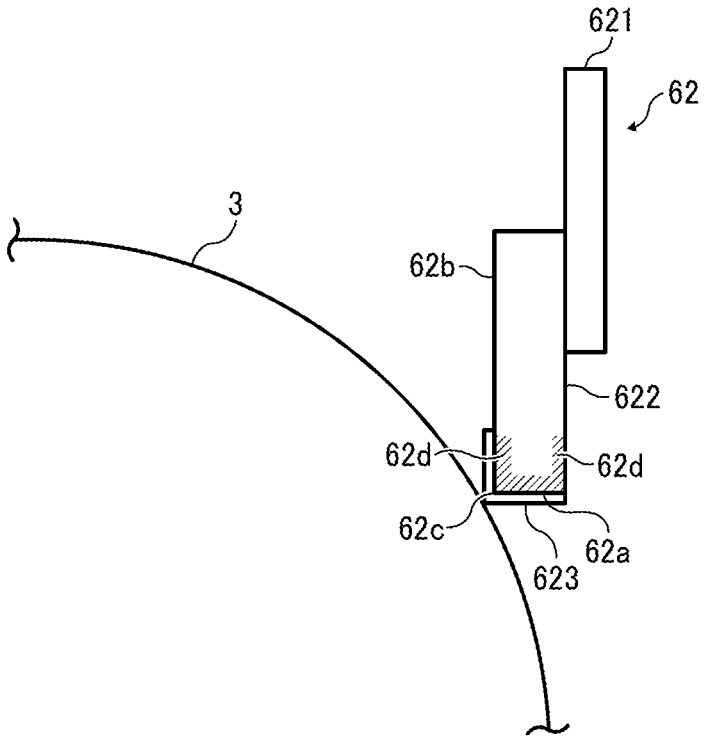
FIG. 8 is an amplified sectional view illustrating a cleaning blade including an impregnated area and a surface layer.

Each of the cleaning blades 1 to 3, 6 to 8, 10 and 11 has an impregnated part 62*d* and a surface layer 623 on each of the blade edge surface 62*a* and the under surface 62*b* as shown in FIG. 8. Each of the cleaning blades 4 and 5 has a surface layer 623 on each of the blade edge surface 62*a* and the under surface 62*b* as shown in FIG. 7.

The Martens hardness a position 20, 200, 300, 500, 1,000, 2,000, 3,000, 4,000, 5,000, 6,000, 7,000 and 8,000 μm far from the tip ridgeline 62*c* of the blade under surface 62*b* on each of the cleaning blades 1 to 9 was measured.

In addition, the Martens hardness a position 20, 200, 300, 500, 1,000, 2,000 and 3,000 μm far from the tip ridgeline 62*c* of the blade under surface 62*b* on each of the cleaning blades 10 and 11 was measured.

The Martens hardness was measured by a microscopic hardness meter HM-2000 from Fischer Instruments is used, in which Vickers indenter is pushed into an object at 1.0 mN for 10 sec, held for 5 sec, and drawn at 1.0 mN for 10 sec. The results are shown in Tables 1 and 2.

TABLE 1(1)

| | 20 | 200 | 300 | 500 | 1,000 | 2,000 |
|---|---|---|---|---|---|---|
| Cleaning blade 1 | 2.4 | 4.8 | 3.0 | 2.0 | 1.6 | 1.3 |
| Cleaning blade 2 | 3.0 | 5.6 | 9.8 | 5.0 | 2.0 | 2.3 |
| Cleaning blade 3 | 5.5 | 2.5 | 5.6 | 3.2 | 2.0 | 1.3 |
| Cleaning blade 4 | 1.2 | 2.3 | 3.2 | 2.2 | 1.3 | 1.5 |
| Cleaning blade 5 | 1.5 | 2.3 | 2.2 | 2.1 | 1.2 | 1.1 |
| Cleaning blade 6 | 0.8 | 1.2 | 1.5 | 1.3 | 1.4 | 1.5 |
| Cleaning blade 7 | 10.1 | 12.0 | 9.5 | 8.6 | 4.5 | 3. |
| Cleaning blade 8 | 2.4 | 2.8 | 4.5 | 2.0 | 2.6 | 2.0 |
| Cleaning blade 9 | 3.0 | 3.5 | 5.0 | 4.0 | 1.2 | 1.6 |

TABLE 1(2)

| | 3,000 | 4,000 | 5,000 | 6,000 | 7,000 | 8,000 |
|---|---|---|---|---|---|---|
| Cleaning blade 1 | 1.2 | 1.4 | 1.5 | 1.1 | 0.6 | 0.6 |
| Cleaning blade 2 | 1.8 | 1.6 | 1.3 | 1.0 | 0.8 | 0.7 |
| Cleaning blade 3 | 1.2 | 1.4 | 1.2 | 1.2 | 0.8 | 0.7 |
| Cleaning blade 4 | 1.4 | 1.6 | 1.2 | 1.1 | 0.5 | 0.3 |
| Cleaning blade 5 | 1.3 | 1.1 | 1.2 | 0.8 | 0.7 | 0.7 |
| Cleaning blade 6 | 1.2 | 1.2 | 1.1 | 1.0 | 0.7 | 0.7 |
| Cleaning blade 7 | 3.2 | 3.1 | 2.5 | 2.0 | 0.7 | 0.7 |
| Cleaning blade 8 | 1.8 | 1.8 | 1.7 | 1.7 | 1.7 | 1.5 |
| Cleaning blade 9 | 1.2 | 0.5 | 0.6 | 0.5 | 0.5 | 0.5 |

TABLE 2

| | 20 | 200 | 300 | 500 | 1,000 | 2,000 | 3,000 |
|---|---|---|---|---|---|---|---|
| Cleaning blade 10 | 3.1 | 3.5 | 3.2 | 2.1 | 1.5 | 1.4 | 0.5 |
| Cleaning blade 11 | 3.1 | 3.5 | 3.2 | 2.1 | 1.5 | 1.4 | 1.4 |

Next, each of the cleaning blades 1 to 11 was installed in Ricoh Pro C751 to evaluate whether poor cleaning occurred at a photoconductor linear speed at 300 and 600 mm/sec. The results are shown in Table 3.

TABLE 3

| | Cleaning blade | 300 mm/sec | 600 mm/sec |
|---|---|---|---|
| Example 1 | Cleaning blade 1 | None | None |
| Example 2 | Cleaning blade 2 | None | None |
| Example 3 | Cleaning blade 3 | None | None |
| Example 4 | Cleaning blade 4 | None | None |
| Example 5 | Cleaning blade 5 | None | None |
| Example 6 | Cleaning blade 10 | None | None |
| Comparative Example 1 | Cleaning blade 6 | Yes | Yes |
| Comparative Example 2 | Cleaning blade 7 | None | Yes |
| Comparative Example 3 | Cleaning blade 8 | None | Yes |
| Comparative Example 4 | Cleaning blade 9 | Yes | Yes |
| Comparative Example 5 | Cleaning blade 11 | Yes | Yes |

As is clear from Tables 1 to 3, each of Comparative Examples 1 and 4 using the cleaning blades 6 and 9, respectively each having a part having a Martens hardness less than 1.0 N/mm$^2$ from the tip ridgeline 62*c* to the L/2 had poor cleaning both at regular speed and high speed. It is thought this is because the tip ridgeline 62*c* did not have enough hardness and the blade was abraded soon.

Comparative Example 2 using the cleaning blade 7 having a part having a Martens hardness greater than 10 N/mm$^2$ from the tip ridgeline 62*c* to the L/2 had poor cleaning at high speed. It is thought this is because the cleaning blade was too hard to follow fine oscillation of the photoconductor.

Comparative Example 3 using the cleaning blade 8 having a Martens hardness greater than 0.8 N/mm$^2$ at a position far from the L/2 had poor cleaning at high speed. It is thought this is because the cleaning blade was too hard to follow fine oscillation of the photoconductor as Comparative Example 1.

Comparative Example 5 using the cleaning blade 11 having a Martens hardness greater than 0.8 N/mm$^2$ at a position far from the L/2 had poor cleaning both at regular speed and high speed.

Each of Examples 1 to 6 using the cleaning blades 1 to 5 and 10, respectively having a Martens hardness of from 1.0 to 10 N/mm$^2$ from the tip ridgeline to the L/2 and a Martens hardness of from 0.3 to 0.8 N/mm$^2$ at a position far from the L/2 could follow fine oscillation of the photoconductor rotated at high speed and had good cleanability for long periods. The tip ridgeline 62*c* did not turn over and no abnormal noise was made. Each of the cleaning blades 1 to 5 had a maximum value of the Martens hardness within 500 μm from the tip ridgeline 62*c*. The tip ridgeline 62*c* having proper hardness is thought to have prevented itself from turning over.

Each of Examples 1 and 4 to 6 using the cleaning blade having a Martens hardness of from 1.0 to 5.0 N/mm$^2$ from the tip ridgeline to the L/2 was abraded less and had lower abrasion speed than each of Examples 2 and 3 using the cleaning blade having a Martens hardness of from 1.0 to 10 N/mm$^2$ from the tip ridgeline to the L/2. The cleaning blade having a Martens hardness of from 1.0 to 5.0 N/mm$^2$ from the tip ridgeline to the L/2 has longer life than the cleaning blade having a Martens hardness greater than 5.0 N/mm$^2$ rom the tip ridgeline to the L/2.

Having now fully described the invention, it will be apparent to one of ordinary skill in the art that many changes and modifications can be made thereto without departing from the spirit and scope of the invention as set forth therein.

What is claimed is:

1. A cleaning blade for cleaning a surface of an object, comprising:

a rigid holder; and a strip-shaped elastic body fixed to a side of the holder, comprising a tip ridgeline configured to contact the surface of the object, wherein the elastic body includes an extension portion that extends beyond the side of the holder in a direction parallel to the side of the holder by a length (L) of not less than 4 mm, wherein a Martens hardness is in a range of from 1.0 to 10.0 N/mm$^2$ at an area from the tip ridgeline to the middle (L/2) of the extension portion on a surface of the blade, and wherein a Martens hardness is in a range of from 0.3 to 0.8 N/mm$^2$ at an area from the middle (L/2) of the extension portion on the surface of the blade to a point where the elastic body first extends beyond the side of the holder in a direction parallel to the side of the holder.

2. The cleaning blade of claim 1, wherein the elastic body has a Martens hardness of from 1.0 to 5.0 N/mm$^2$ from the tip ridgeline to the middle (L/2) thereof.

3. The cleaning blade of claim 1, wherein the elastic body has a maximum value of the Martens hardness within 500 μm from the tip ridgeline.

4. The cleaning blade of claim 1, wherein the elastic body comprises a part where a polyurethane rubber and an acrylic cured resin are mixed.

5. An image foil ling apparatus, comprising:

an image bearer;

a cleaning member configured to contact the surface of the image bearer to remove an unnecessary material adhering thereto; and a transfer member configured to transfer an image on the image bearer onto a recording medium, wherein the cleaning member is the cleaning blade according to claim 1.

6. A process cartridge detachable from image forming apparatus, comprising:

an image bearer; and a cleaning member configured to contact the surface of the image bearer to remove an unnecessary material adhering thereto, wherein the cleaning member is the cleaning blade according to claim 1.

7. A cleaning blade cleaning a surface of an object, comprising:

a rigid holder; and a strip-shaped elastic body fixed to a side of the holder, comprising a tip ridgeline configured to contact the surface of the object, wherein the elastic body includes an extension portion that extends beyond the side of the holder in a direction parallel to the side of the holder by a length (L) of not less than 4 mm, wherein a Martens hardness is in a range of from 1.0 to 10.0 $N/mm^2$ from the tip ridgeline to the middle (L/2) of the extension portion, and wherein a Martens hardness is in a range of from 0.3 to 0.8 $N/mm^2$ from the middle (L/2) of the extension portion to a point where the elastic body first extends beyond the side of the holder in a direction parallel to the side of the holder, wherein the elastic body comprises a part where a polyurethane rubber and an acrylic cured resin are mixed, and wherein the acrylic cured resin comprises a fluorine-based acrylic monomer.

* * * * *